United States Patent [19]

Sloan

[11] 4,145,791

[45] Mar. 27, 1979

[54] ROLL CLEANING APPARATUS

[75] Inventor: Donald A. Sloan, Winston-Salem, N.C.

[73] Assignee: Hanes Corporation, Winston-Salem, N.C.

[21] Appl. No.: 852,675

[22] Filed: Nov. 18, 1977

[51] Int. Cl.[2] ..... A47L 5/26

[52] U.S. Cl. ..... 15/344; 15/370; 15/386; 15/409

[58] Field of Search ..... 15/344, 370, 386, 409, 15/89, 92, 383; 30/133, 276, 347

[56] References Cited

U.S. PATENT DOCUMENTS

| | | | |
|---|---|---|---|
| 862,053 | 7/1907 | Cobb | 15/383 X |
| 1,287,028 | 12/1918 | Johnson | 15/92 |
| 2,746,078 | 5/1956 | Spurlin | 15/344 |
| 3,006,022 | 10/1961 | Mamontov | 15/386 X |
| 3,859,776 | 1/1975 | Ballas et al. | 56/295 X |

*Primary Examiner*—Christopher K. Moore

*Attorney, Agent, or Firm*—Charles Y. Lackey; William S. Burden

[57] ABSTRACT

A hand held lightweight apparatus for cleaning lint and fiber waste from the clearer rolls of spinning frames without removing such rolls from the spinning frame includes a driven, monofilament nylon flail which revolves at high speed within a suction head coupled to a vacuum producing apparatus. The nylon cord extends through an opening of the suction head upon each revolution of the driven flail device and the whipping action tears the accumulated lint and waste from the clearer rolls, while sightly roughening the roll surfaces, and the waste is directed to a collection point.

10 Claims, 7 Drawing Figures

ROLL CLEANING APPARATUS

BACKGROUND, BRIEF SUMMARY, AND OBJECTS OF THE INVENTION

In the spinning of fibers, roving is drawn or drafted by a series of pairs of rollers, or by driven feed aprons in combination with pairs of driven rollers prior to the fibers' reaching the actual spinning devices.

Portions of the fibers and lint become detached from the roving during the drawing of the roving and the delivery or feedout rolls tend to accumulate such lint and small pieces of fibers and trash on their surfaces. This lint, trash and fibers will eventually build up into a ring all the way around the delivery roll and eventually break spinning ends. Scrapers, vacuum slots, etc. have been previously utilized in an effort to maintain the delivery rolls in a clean condition. The usual practice is to provide clearer rolls which bear against and rotate with the delivery top rolls. The clearer rolls are covered with material such as velvet, cork, etc. to give them a greater affinity for the short fibers and trash on the delivery rolls. Although these clearer rolls run for a number of days before they have to be cleaned, cleaning is required regularly to keep the lint and particles from falling back onto their work. The rolls are sometimes manually cleaned by an operator running a hand down the clearer rolls such that all material is rolled into a doughnut-shaped lint mass which then can be placed in a receptacle. However, such cleaning action is time-consuming.

Another prior procedure involved removing the clearer rolls one by one and replacing them with clean rolls. The dirty rolls are collected in a large container and transported to a location where they are individually cleaned with compressed air. However, this procedure also is time-consuming; and cleaning with compressed air directs more lint into the air, further aggravating an existing airborne lint condition.

U.S. Pat. No. 2,562,451 to Delepierre et al discloses an apparatus for stripping lint and fibers from the clearer rolls of a spinning frame as the apparatus advances slowly along the frame. An endless band of card clothing is displaced generally axially of the clearer rolls by means of cones which are in frictional engagement with the clearer rolls. However, the strip of card clothing must be periodically replaced by a clean strip; and, apparently, the cleaning apparatus would necessarily be periodically transported from one end of a frame to the other since the cleaning apparatus advances in the direction opposite to the apices of the cones.

Hand held cleaning devices including power-driven brushes for cleaning clothes, brushing hair and the like, are known, for example, as disclosed by U.S. Pat. Nos., 2,578,549; 3,079,627; 3,368,231 and 3,872,539. However, such conventional devices are impractical, inadequate and inconvenient for cleaning lint and fibers from the clearer rolls of textile spinning frames.

The present invention is directed to a new and improved small, lightweight, portable cleaning apparatus for readily and safely cleaning to maximum efficiency the clearer rolls as they rotate upon a spinning frame. A hand held, driven, high-speed flail device is combined with a suction mechanism to effectively strip fibers, lint or trash from the rolls and convey such materials to a collection receptacle. While the apparatus illustrated includes an electric motor for driving the flail device and a portable vacuum bag for collecting the waste and trash, it is to be understood that the flail device may be driven by a pheumatic motor, and the waste may be directed to a conventional vacuum cleaner or a central location.

One of the primary objects of the invention is the provision of a new and improved portable, lightweight, hand held device for cleaning waste material from clearer rolls rotating upon a spinning frame.

Another object of the invention is the provision of a clearer roll cleaner which is compact and convenient to use.

Still another object of the invention is the provision of a clearer roll cleaner which is safe and efficient in operation and inexpensive to manufacture and maintain.

A further object of the invention is the provision of a device which utilizes airflow and a flail action for rapidly stripping lint and waste material from the clearer rolls.

Other features and advantages of the invention will become apparent to those skilled in the art during the course of the following detailed description of the invention.

DETAILED DESCRIPTION OF THE INVENTION

Figure 1:
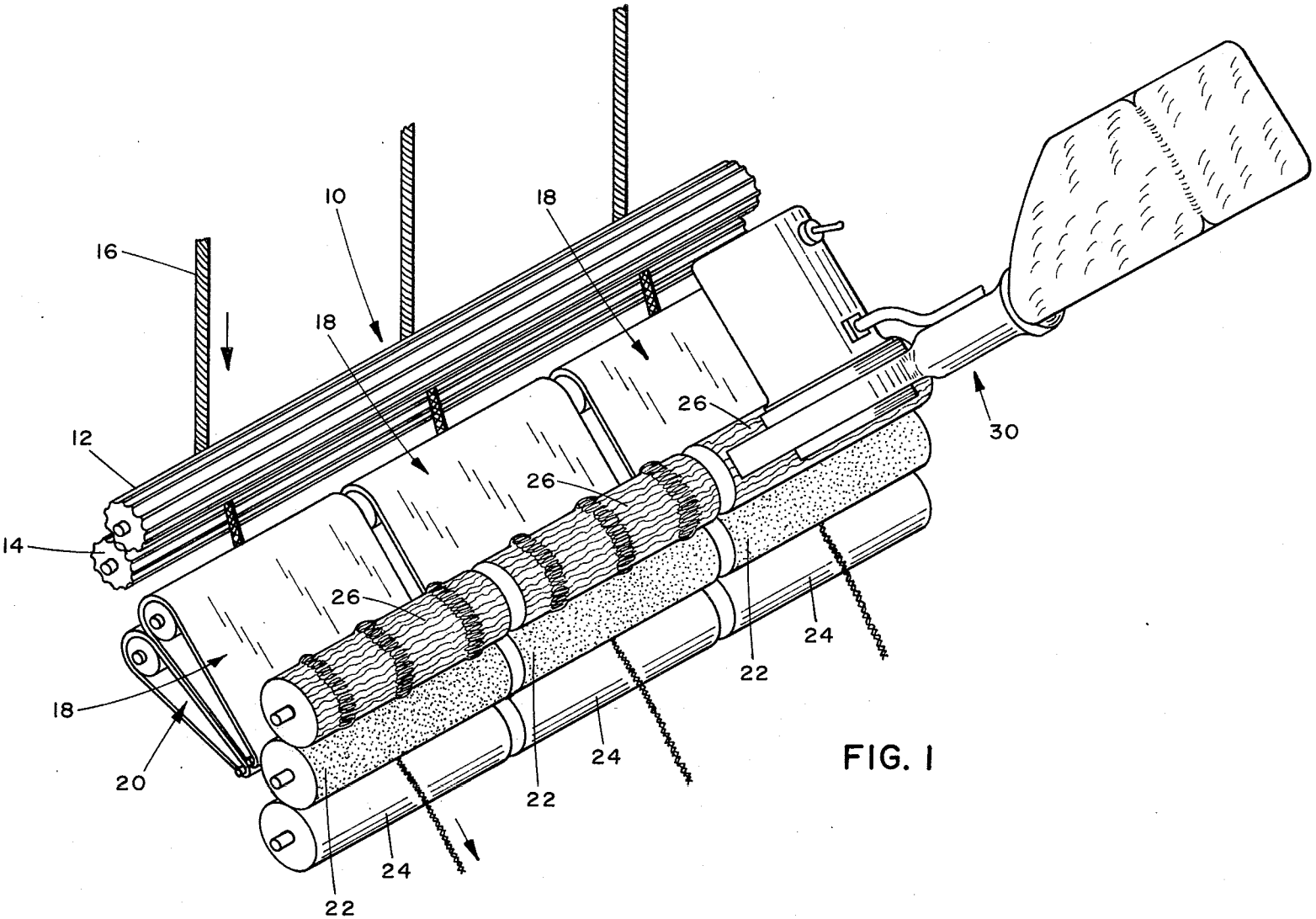
FIG. 1 is a fragmentary, perspective view of the clearer rolls and the drafting aprons and rolls of a conventional spinning frame, and illustrating the portable clearer roll cleaner of the present invention.

Referring to the drawing, and particularly to FIG. 1, the drawing assembly 10 includes a series of pairs of infeed rolls 12, 14 for initially receiving roving 16 to be drafted, a series of pairs of drafting aprons 18, 20, spaced from the infeed rolls, and a series of cooperating pairs of front rolls 22, 24 spaced from the aprons 18, 20. The surface speed of the various rolls and aprons progressively increases in the direction of roving travel to draw the roving to a desired size prior to twisting of the fibers.

The infeed rolls 12, 14 may be fluted, if desired, and at least one roll of each pair of front rolls is covered with a soft, pliable material. The belts or aprons 18, 20 also are formed of a suitable material to frictionally grip and facilitate drawing of the roving.

During the drafting operation, the front rolls 22, 24 tend to accumulate small pieces of broken fibers and trash on their surfaces. Unless removed in some manner, the fibers and trash will eventually build up to a doughnut shape completely around the front rolls, and consequently break the ends of the spinning frame.

It has been the conventional practice to provide clearer rolls 26 which are preferably biased into frictional driving engagement with the upper, soft roll of each pair of front rolls. The clearer rolls are covered with cork, velvet, cloth or other suitable means having a greater affinity for the short fibers, lint, trash, etc., than the front rolls 22, 24. The clearer rolls 26 are periodically cleaned to remove lint and trash therefrom.

The infeed rolls, drafting aprons and front rolls are mounted for rotation upon the spinning frame by means of roll stands, bearings, etc., or other means in a conventional manner.

FIG. 1 also illustrates the roll cleaning device 30 positioned for movement in a direction generally parallel with the clearer roll axis for stripping lint and waste from the clearer rolls.

Figure 6:
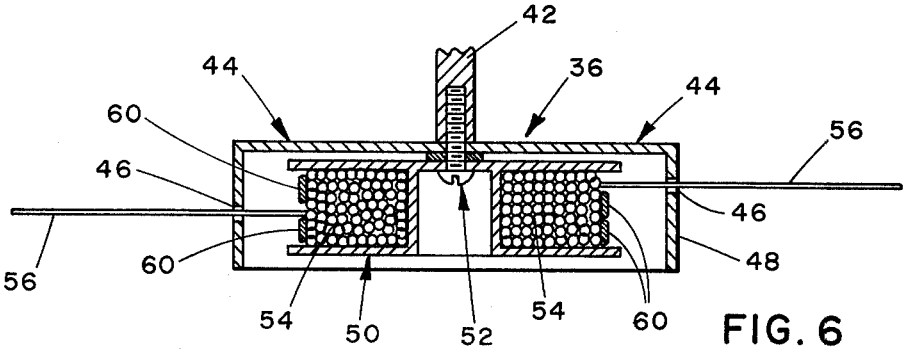
FIG. 6 is a sectional view of the apparatus of FIG. 5, illustrating the manner of supporting and retaining the monofilament line.

In the embodiment illustrated, the clearer roll cleaning device 30 includes a cylindrical housing 32 defining a chordwise opening 34 and a handle portion 40, a flail 36, FIG. 6, and a motor 38 for driving the flail device.

The motor 38, which is illustrated as an electric motor, transmits rotational movement to the flail device 36 by means of shaft 42. The shaft 42 may be the motor shaft or an extension of the motor shaft. Rigidly secured to the outer end of the drive shaft 42 is the flail device 36. The flail device includes an inverted cup-shaped cover member 44, a spool-like member 50 attached to the shaft 42 by releasable fastener 52, and one or more lengths of cord or filament 54 wound upon the spool member 50.

The cup-shaped member 44 is rigidly secured to the driven shaft 42 as by welding or other suitable means, and is provided with one or more openings 46 which extend radially through the peripheral wall 48.

Figure 5:
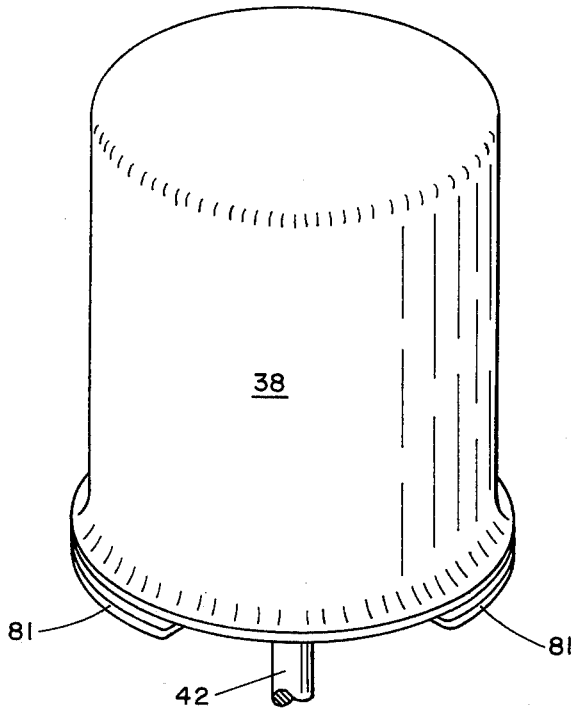
FIG. 5 is an enlarged perspective view of the drive motor and flail device for stripping lint and waste from the clearer rolls.
Figure 5:
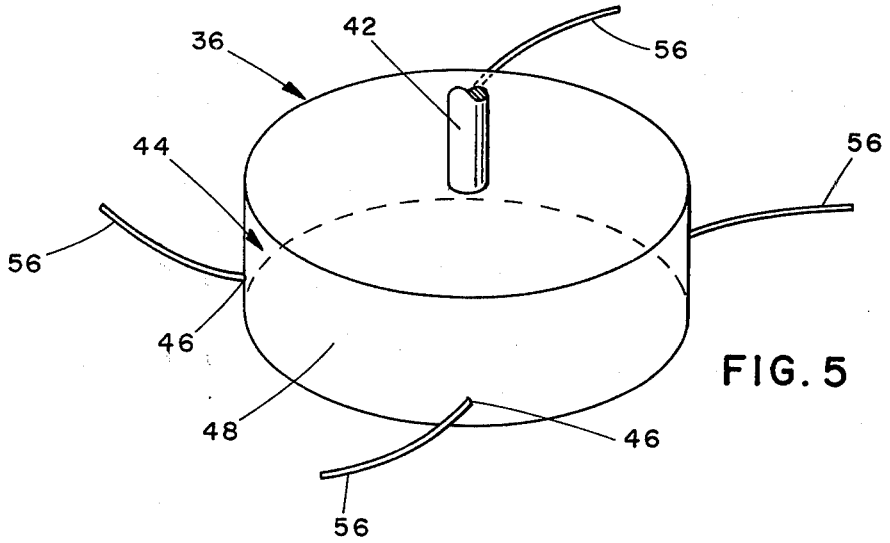

The spool member 50 is releasably secured to the shaft 42 by fastener 52 and normally rotates with the cup-like member 44 upon actuation of the drive motor 38. In the embodiment illustrated, four lengths of nylon cord or other suitable filament 54 are wound upon spool member 50 with the outer end of each length passing through an opening 46 in the cup-like member 44, as shown by FIGS. 5 and 6. It is to be noted that the radially extending openings are spaced at approximately 90° intervals around the peripheral wall 48 and also spaced from each other longitudinally in the direction of the rotational axis of shaft 42. Axial spacing of the openings 46 permits the filament ends 56 to cover an effective width of approximately ⅜" with the flail device 36 held in a stationary position.

Figure 2:
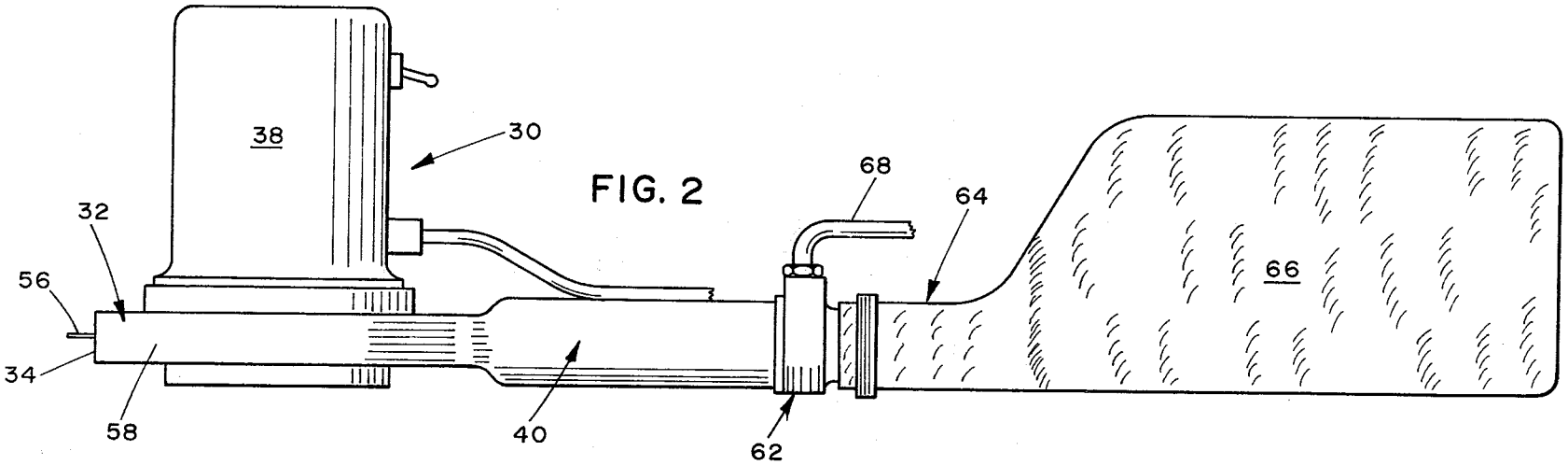
FIG. 2 is a schematic, fragmentary, side elevational view of the clearer roll cleaning device of the present invention.
Figure 3:
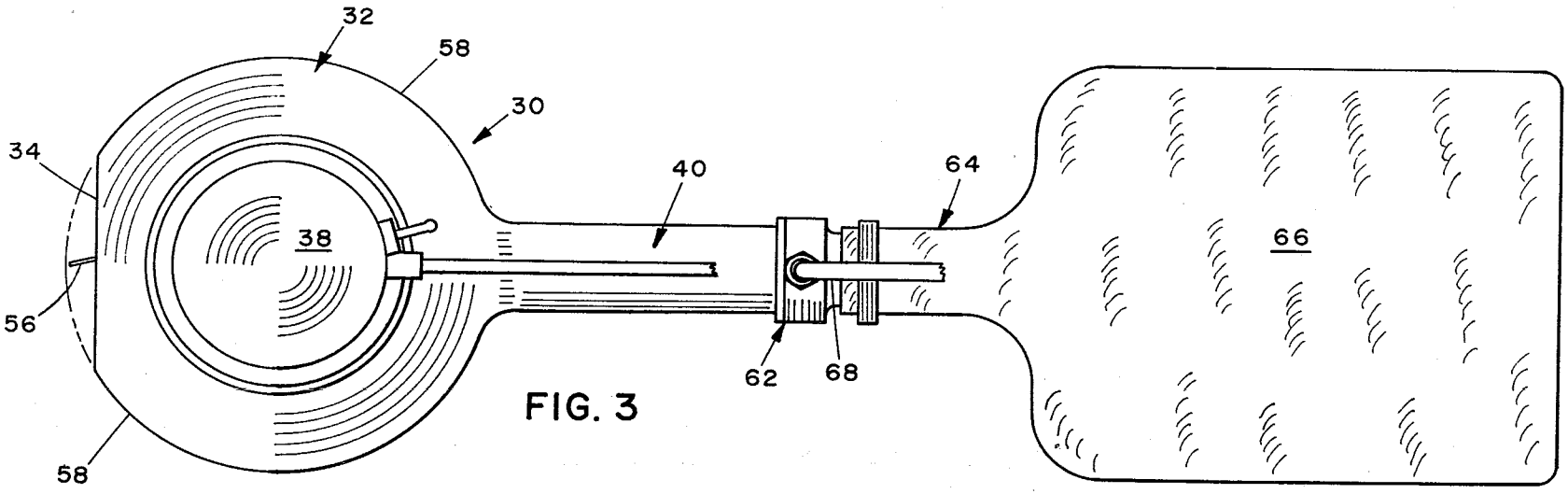
FIG. 3 is a schematic, fragmentary, top plan view of the device of FIG. 2.

Due to centrifugal force, upon rotation of the flail device, the free ends of the filaments fly outwardly radially for a distance to just contact or be slightly spaced inwardly from the inner surface of peripheral wall 58 of the cylindrical housing 32. With each revolution of the flail device 36, the outer end 56 of each cord or filament projects outwardly of the housing 32 at the cutaway portion defining opening 34, as shown by FIGS. 2 and 3. Elastic bands 60, FIG. 6, or other suitable means, are provided to prevent inadvertent unwinding of the coiled portions of the filaments 54 from the spools 50.

Upon actuation of the motor 38, the free ends 56 of the filaments swing arcuately in the manner of a flail to strip the loose fibers and lint from the clearer rolls in a manner to be subsequently described. As the projecting ends 56 of the filaments 54 wear and become shortened during use, the fastener 52 is loosened and the spool 50 rotated relative to the cup-like member 44 to pay out additional line and increase the effective working length. The fastener 52 again is actuated to effectively secure the spool 50 and cup-like member 44 for simultaneous rotation. If the lengths of the ends 56 extending outwardly of the opening 46 are excessive, they will be automatically cut or trimmed to the desired length, upon actuation of the motor 38, as they rotate and contact the edge of the housing 32 defining the chordwise opening 34.

Rather than utilizing the fastener 29 for releasably securing the spool 50 and the cup-like member 44 together, various suitable arrangements, including friction means, locking pins, etc., may be provided for selectively permitting rotation of the spool member 50 relative to the cup-like member.

The line or filament 54 may be of various materials or constructions but preferably is of a high polymer synthetic material, such as nylon monofilament, which is capable of effectively stripping material from the clearer rolls without damaging the roll surfaces. The spool 50 and member 44, preferably are of lightweight, plastic construction, but may be formed of other various constructions and configurations.

A suction is created in the suction head or cover 32 for transmitting waste materials removed from the clearer rolls through the tubular handle 40, airflow amplifier 62, flexible hose 64 and into a waste receptacle 66. Releasable couplings may be provided at each end of the hose 64 for attachment to the handle 40 and to the receptacle 66. Although not illustrated on the drawing, it is to be understood that the receptacle 66 may be in the form of a lightweight bag provided with straps and adapted to be supported by an operator.

Figure 4:
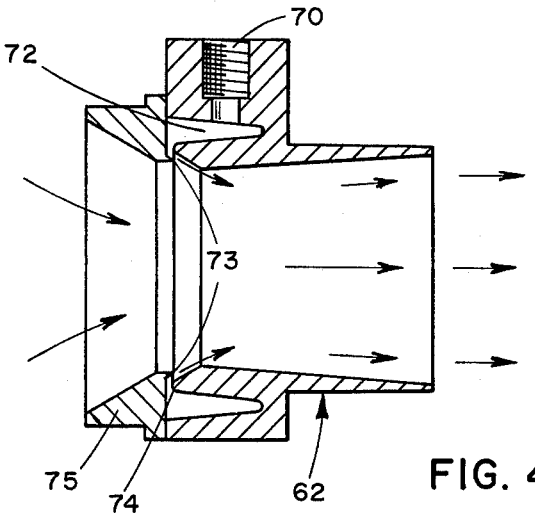
FIG. 4 is an enlarged sectional view of an airflow amplifier for directing the lint and waste stripped from the clearer rolls to a receptacle.
Figure 7:
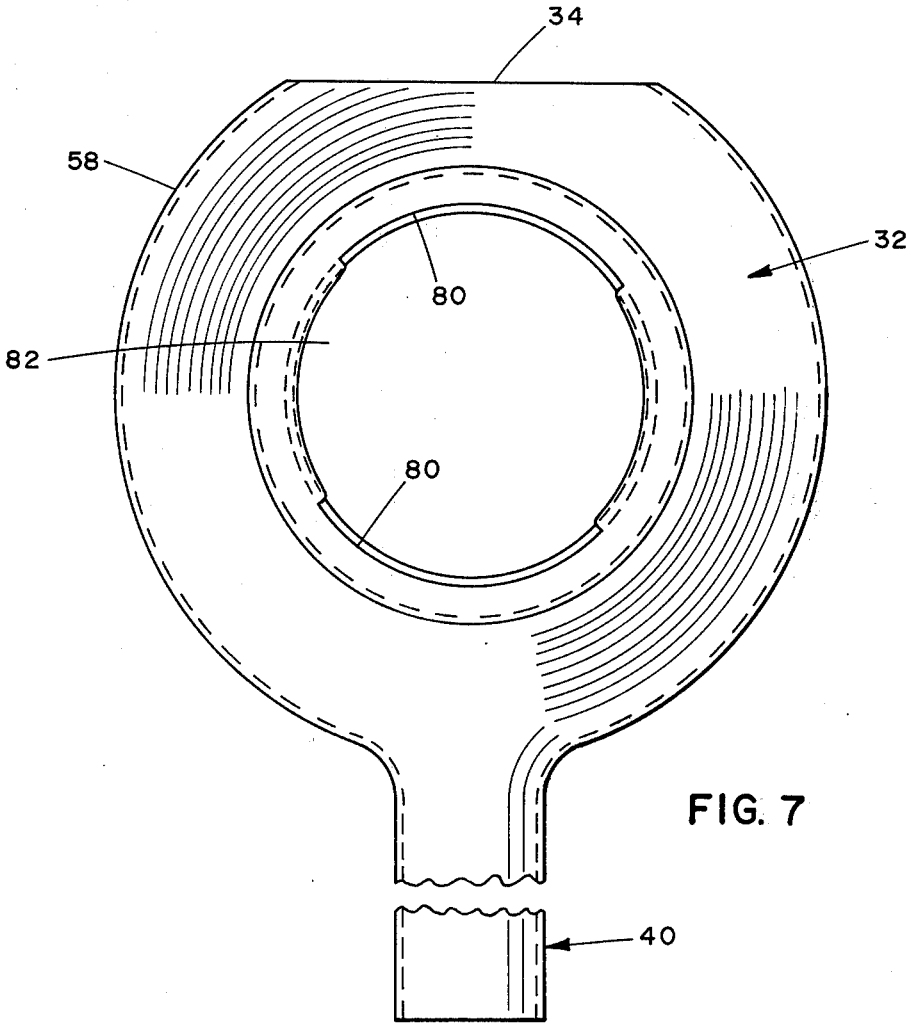
FIG. 7 is a fragmentary, top plan view of the suction head with the flail device and drive motor removed therefrom.

The suction through opening 34 is created by the air amplifier 62 which, in turn, is coupled through conduit 68 to a compressed air source, not shown. Compressed air flows from line 68 through the inlet 70, FIG. 4, and into the annular chamber 72 surrounding a ring nozzle 74. The air is throttled through the ring nozzle 74 in a radial inward direction perpendicular to the center line of the amplifier 62. The air attains sonic velocity in the nozzle and the high velocity air leaving the nozzle is deflected by a small lip 73 on the inlet ring 75. As the primary air passes through the throat of the amplifier 62, it collides with the still air causing the primary air to slow down and the secondary air to accelerate toward the outlet, thus instantly establishing a large highly amplified flow of air 15 to 20 times as great as the compressed air consumption through conduit 68. As previously indicated, the flail device may be driven from an air motor, rather than from electric motor 38, with the compressed air source being coupled through conduit 68 or other suitable conduit means. The airflow amplifier may be of the type manufactured by Vortec Corporation, of Cincinnati, Ohio.

The motor 38 is releasably coupled in a conventional manner to the housing or suction nozzle 32 by means of locking flanges 80 adjacent an opening 82, which cooperate with flanges 81 on the housing of motor 38. The opening 82 permits positioning of the flail device 36 within the suction head or nozzle housing 32.

In cleaning of clearer rolls rotating upon a spinning frame, an operator positions the device with the drive shaft of the motor 38 extending perpendicular with respect to the rotational axis of the clearer rolls 26, or at an angle of approximately 45° with respect to the clearer roll axis. The flail device 36 is driven at approximately 10,000 revolutions per minute, and the gentle whipping action of the free cord end or ends 56 as they extend through opening 34 is sufficient to tear the accumulated cotton waste from the clearer rolls immediately on contact therewith and slightly roughen the roll surfaces without damaging the rolls. The waste removed by the cords 56 is drawn into the suction head or housing member 32, due to the vacuum created by the compressed air passing through the airflow amplifier, and passes through handle 40, flexible hose 64 and into the receptacle 66. The hand held flail device is advanced by the operator longitudinally of the rotating clearer rolls to completely clean the rolls.

What is claimed is:

1. A lightweight cleaning device for continuous spinning frames and the like textile machines having at least one pair of drawing rolls and a waste clearer roll rotating in engagement with one of said pair of drawing rolls, comprising, a drive motor, a flail device driven by said motor, housing means substantially encompassing said flail device and releasably supporting said drive motor exteriorly thereof, said housing means defining an inlet opening and a tubular portion forming a handle for support of the device in the hand of an operator, said flail device including at least one flexible cord periodically passing through said inlet opening and outwardly of said housing means to contact the annular surfaces of the rotating clearer roll and effectively tear accumulated lint and waste from the clearer roll as said device is displaced longitudinally of the clearer roll, and means creating a suction air flow through said housing means including said tubular handle portion for directing waste torn from the rotating clearer roll by said flail device through said inlet opening and handle portion into a collection receptacle.

2. A cleaning device as recited in claim 1, wherein said flail device includes a plurality of flexible cords mounted for rotation about a common axis, said cords being longitudinally spaced along said axis.

3. A cleaning device as recited in claim 1, said flail device further including a cover member secured for rotation with the shaft of said drive motor and defining at least one guide opening for receiving said flexible cord therethrough, spool means having said flexible cord wound thereon and normally mounted for rotation with said cover member, and releasable means selectively permitting rotation of said spool means relative to said cover member for withdrawing an additional length of said cord from said spool means through said cover member guide opening.

4. A cleaning device as recited in claim 1, said suction creating means including an airflow amplifier connected to a source of compressed air for directing dislodged waste material to said collection receptacle.

5. A cleaning device as recited in claim 1, wherein said housing means includes a cylindrical portion encircling said flail device, and said inlet opening extends chordwise of said cylindrical portion.

6. A cleaning device as recited in claim 5, wherein said driven motor and said housing cylindrical portion further include cooperating means for releasably coupling said drive motor upon said housing means.

7. A cleaning device as recited in claim 5, said suction creating means including an airflow amplifying device positioned intermediate said handle portion and said receptacle for transferring the dislodged waste through said housing means cylindrical portion and said handle portion to said receptacle.

8. A portable, lightweight device for support in the hand of an operator for releasing lint and waste fibers wrapped around clearer rolls rotating upon a textile spinning frame by displacing the device axially of the rotating clearer rolls to tear accumulated lint and fibers from the surfaces of clearer rolls comprising, housing means including a hollow portion defining an inlet opening therein, motor means, a flail device including a flexible cord secured within said housing and driven by said motor means, means releasably mounting said motor means and said flail device upon said housing means hollow portion with said motor means being positioned exteriorly of said housing means, the outer end of said cord periodically passing through said inlet opening and outwardly of said housing means, upon rotation of said motor means, for contacting rotating clearer rolls to effectively tear lint and fibers deposited upon the clearer rolls from the clearer rolls, said housing means further defining a support handle portion for directing dislodged waste material there through to a receptacle in response to an airflow therethrough from said inlet opening created by an airflow creating means.

9. A cleaning device as recited in claim 8, wherein said flail device includes a spool, a cover member driven by said motor means and concentrically mounted with respect to said spool and defining a plurality of angularly spaced guide openings therein, a plurality of flexible cords wound upon said spool, the outer end portions of each cord extending through the openings within said cover member and upon rotation of said flail device passing through said housing inlet opening and outwardly of said housing to contact the clearer rolls and remove lint and waste therefrom.

10. A cleaning device as recited in claim 8, wherein said cord is of high polymer, synthetic, monofilament construction.

* * * * *